United States Patent [19]

Levengood et al.

[11] Patent Number: 4,753,575

[45] Date of Patent: Jun. 28, 1988

[54] AIRFOIL WITH NESTED COOLING CHANNELS

[75] Inventors: James L. Levengood, West Hartford, Conn.; Thomas A. Auxier, Lake Park, Fla.

[73] Assignee: United Technologies Corporation, Hartford, Conn.

[21] Appl. No.: 82,402

[22] Filed: Aug. 6, 1987

[51] Int. Cl.[4] ..... F01D 5/18

[52] U.S. Cl. ..... 416/97 R; 415/115

[58] Field of Search ..... 416/97 R, 96 R, 96 A, 416/115

[56] References Cited

U.S. PATENT DOCUMENTS

| | | | |
|---|---|---|---|
| 3,533,711 | 10/1970 | Kercher | 416/97 R X |
| 3,628,885 | 12/1971 | Sidenstick et al. | 416/97 R |
| 3,807,892 | 4/1974 | Frei et al. | 416/97 R X |
| 4,073,599 | 2/1978 | Allen et al. | 416/97 R |
| 4,180,373 | 12/1979 | Moore et al. | 415/115 X |
| 4,474,532 | 10/1984 | Pazder | 416/97 R |
| 4,500,258 | 2/1985 | Dodd et al. | 416/96 R X |
| 4,514,144 | 4/1985 | Lee | 416/97 R X |
| 4,604,031 | 8/1986 | Moss et al. | 416/97 R |

FOREIGN PATENT DOCUMENTS

| | | | |
|---|---|---|---|
| 170801 | 10/1983 | Japan | 416/97 R |
| 202304 | 11/1983 | Japan | 416/97 R |
| 160002 | 9/1984 | Japan | 416/97 R |
| 846583 | 8/1960 | United Kingdom | 416/97 R |

*Primary Examiner*—Everette A. Powell, Jr.

*Attorney, Agent, or Firm*—Stephen E. Revis

[57] ABSTRACT

A hollow, cooled airfoil has a pair of nested, coolant channels therein which carry separate coolant flows back and forth across the span of the airfoil in adjacent parallel paths. The coolant in both channels flows from a rearward to forward location within the airfoil allowing the coolant to be ejected from the airfoil near the leading edge through film coolant holes.

11 Claims, 5 Drawing Sheets

FIG. 2
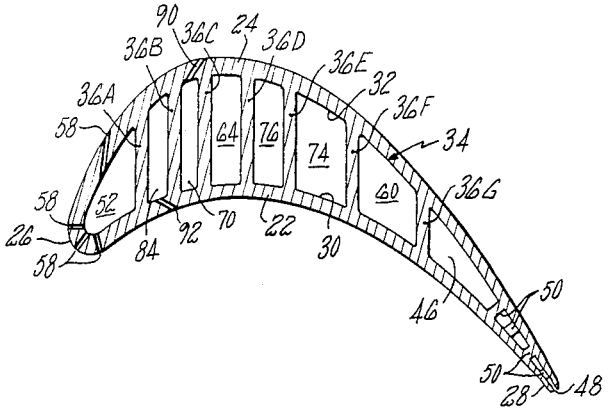
FIG. 3
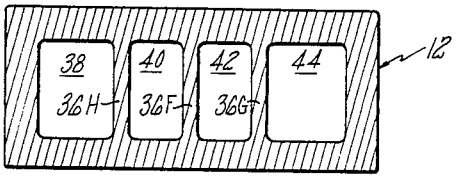
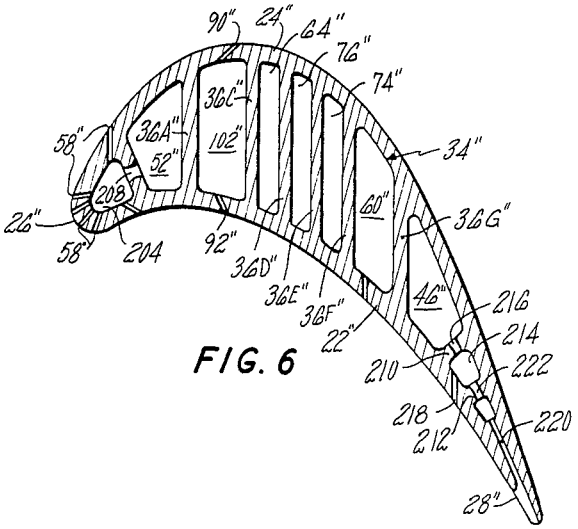
FIG. 6

AIRFOIL WITH NESTED COOLING CHANNELS

CROSS REFERENCE TO RELATED APPLICATIONS

This application is of related subject matter to commonly owned copending application Ser. No. 082,403 filed on even date herewith titled *Triple Pass Cooled Airfoil* by Thomas A. Auxier, Kenneth B. Hall, and Kenneth K. Landis.

TECHNICAL FIELD

This invention relates to hollow, cooled airfoils.

BACKGROUND ART

Hollow, cooled airfoils are well known in the art. They are used extensively in the hot turbine section of many of today's gas turbine engines to maintain metal temperatures within acceptable limits. It is desirable to cool the airfoil to an acceptable level using a minimum mass of coolant flow. This is accomplished by a variety of techniques including film, convective, and impingement cooling. Often the interior of the airfoil is a cavity extending from the leading to the trailing edge and from the root to the tip; and that cavity is divided, by ribs, into a plurality of spanwise extending channels which receive a flow of coolant therein from passages within the root of the airfoil. The ribs are used to create a pattern of flow passages within the airfoil to cause, for example, the same unit mass of coolant to traverse a large area of the internal wall surface to maximize use of its cooling capacity.

In the airfoil shown in U.S. Pat. No. 4,514,144 to Lee, individual, separate spanwise coolant passages carry coolant into heat exchange relationship to the leading and trailing edge, respectively. Each of those channels is fed from a separate coolant passage through the root. The remainder of the airfoil is cooled by a single serpentine channel which carries coolant fluid received from yet another passage through the root. The serpentine channel comprises a plurality of adjacent spanwise extending legs in series flow relation, with the rear-most leg first receiving the coolant fluid. The fluid passes across the spanwise length of the blade in serpentine fashion to the front-most leg and exits through film cooling holes through the airfoil sidewalls, which holes intersect the channel legs. Hollow airfoil coolant configurations somewhat similar to the Lee configuration are shown in U.S. Pat. No. 3,628,885 and Japanese Pat. No. 58-170801 issued Nov. 7, 1983. The former, like Lee, includes a five-pass serpentine channel, while the latter describes a three-pass serpentine channel.

U.S. Pat. No. 3,533,711 shows an airfoil having a pair of serpentine channels, each receiving a separate flow of coolant from a common plenum below the blade root. The inlet legs of the serpentine channels are parallel and adjacent each other and are located centrally of the airfoil. The coolant flow in the rear-most serpentine channel traverses the span of the airfoil as it travels toward and ultimately cools and exits the trailing edge of the airfoil. The coolant flow within the front-most serpentine channel traverses the span of the airfoil as it moves toward and ultimately cools the leading edge of the airfoil.

In U.S. Pat. No. 4,073,599 the airfoil coolant cavity is also divided into a pair of separate serpentine channels; however, the coolant is introduced into the front-most serpentine channel via its leg nearest the leading edge.

That fluid travels toward the trailing edge as it traverses the span of the airfoil, and it exits the airfoil from its rear-most leg, which leg is centrally located within the airfoil cavity and immediately forward of and adjacent the other serpentine channel.

While the prior art configurations may perform adequately for the applications for which they were designed, newer applications are becoming more and more demanding, requiring the development of more efficient cooling configurations for airfoils which need to operate in even hotter environments. At the same time demands are being made to minimize airfoil weight and the amount of coolant needed to do the job.

DISCLOSURE OF INVENTION

One object of the present invention is an improved internal cooling configuration for a hollow cooled airfoil.

According to the present invention the cavity of a hollow, cooled airfoil comprises a pair of nested, U-shaped channels for carrying separate coolant flows back and forth across the spanwise length of the airfoil, and at least one additional spanwise channel leg forward of both U-shaped channels and in series fluid flow communication with at least one of said U-shaped channels for receiving coolant fluid therefrom and for carrying that fluid in another pass across the span of the airfoil.

As used herein and in the appended claims, a U-shaped channel is a channel comprising a pair of longitudinally extending, substantially parallel channel legs in series fluid communication with each other through a generally chordwise extending interconnecting leg.

Unlike prior art configurations, such as the one described in U.S. Pat. Nos. 4,514,144 to Lee, and 3,628,885 to Sidenstick et al. which use a single serpentine cooling channel to cool the entire portion of the airfoil between the leading and trailing edge channels, the present invention divides the coolant flow into two parallel flows, each making fewer passes across the airfoil and thereby reducing the total turn-loss pressure drop of the coolant fluid. Since each unit mass of coolant needs to do less turn work within the airfoil, the present invention allows more pressure drop for radial convection or, alternatively a lower blade supply pressure. It is also possible, using the nested channel configuration of the present invention, to provide coolant flows under different pressure within each channel or to use channel to channel crossover holes for manufacturing advantage (e.g., for better core support during casting).

In one configuration particularly suited to providing flows under different pressure, each U-shaped channel is in series flow relation with a respective separate spanwise extending channel leg to form two independent serpentine channels (i.e., channels having at least three spanwise legs). If desired, in that configuration one serpentine channel may be used to provide film cooling at one pressure and flow rate to the pressure side of the airfoil, while the other serpentine channel may be used to provide film cooling to the suction side at a different pressure and flow rate.

Another advantage of the present invention is that the flow through both of the nested U-shaped channels may initially be introduced into the rear-most leg of each channel and move forward through the coolant cavity toward the leading edge of the blade. This permits all or most of the coolant to be ejected from the airfoil (such as through film coolant holes) near the leading edge of the blade, which is beneficial for many applications. In contrast, in U.S. Pat. No. 3,533,711 the portion of the coolant fluid flowing in the rear-most U-shaped channel must necessarily leave the airfoil near or through the trailing edge. Similarly, in the configuration shown in U.S. Pat. No. 4,073,599 the flow through both of the serpentine channels moves rearwardly as it traverses the airfoil.

In sum, the airfoil coolant passage configuration of the present invention has all of the advantages of the prior art configurations, without some of the disadvantages; and it has some advantages of its own which are not provided by the prior art. For example, structurally the airfoil configuration of the present invention is as strong as prior art configurations because it has a large number of spanwise extending ribs. Additionally, all or as much of the coolant as desired which passes through the U-shaped, nested channels can be ejected from the airfoil through film coolant holes near the front or leading edge of the airfoil. Finally, despite the multiple spanwise passages within the cavity, the pressure drop is less than occurs with a single serpentine channel which makes an equal number of passes across the airfoil span. None of the prior art configuration provides all of the forgoing advantages at the same time.

The foregoing and other objects, features and advantages of the present invention will become more apparent in the light of the following detailed description of preferred embodiments thereof as illustrated in the accompanying drawing.

BRIEF DESCRIPTION OF THE DRAWING

FIG. 2 is a sectional view taken along the line 2—2 of FIG. 1.

FIG. 3 is a sectional view taken along the line 3—3 of FIG. 1.

FIG. 6 is a sectional view taken along the line 6—6 of FIG. 5.

BEST MODE FOR CARRYING OUT THE INVENTION

Figure 1:
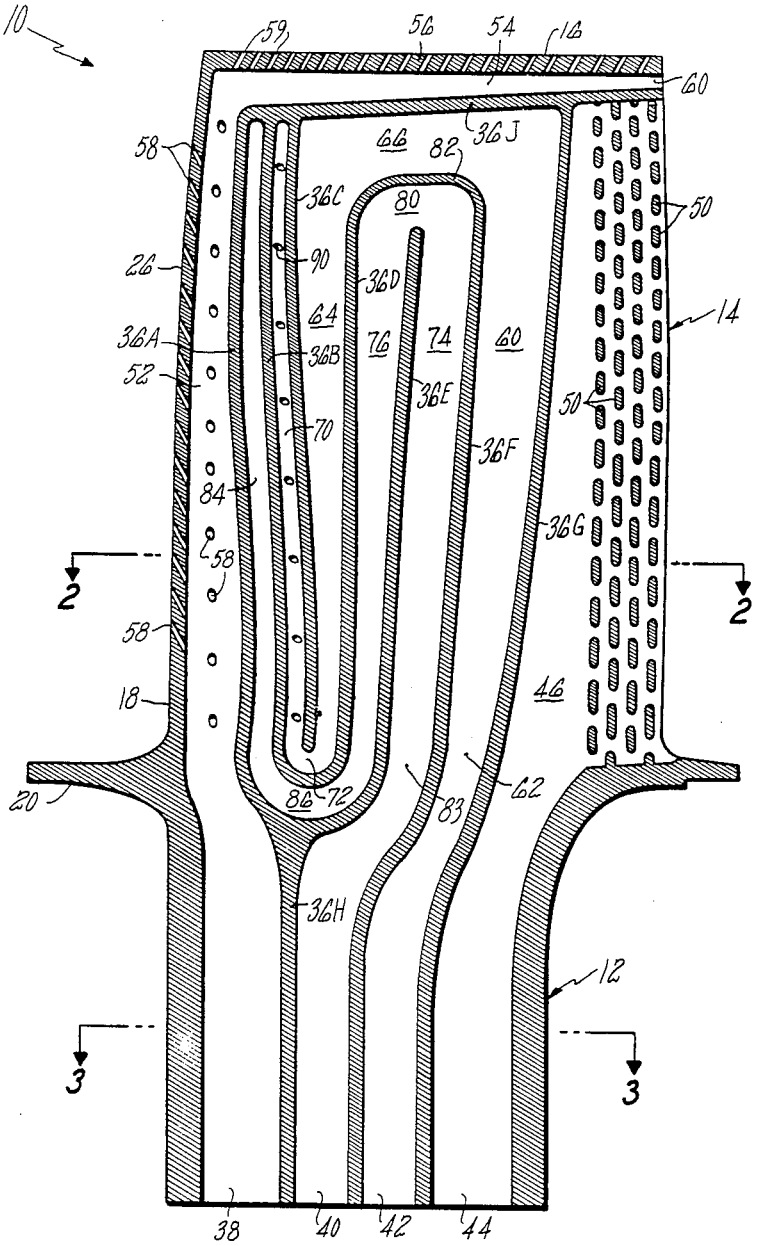
FIG. 1 is a sectional view thru a hollow turbine blade incorporating the features of the present invention.

Consider, as an exemplary embodiment of the present invention, the gas turbine engine turbine blade of FIGS. 1–3 generally represented by the reference numeral 10. The blade 10 comprises a substantially hollow root 12 and a hollow airfoil 14 integral therewith. The airfoil 14 includes a tip 16 and a base 18. A platform 20 is integral with the base 18 where it joins the root 12. The airfoil 14 comprises a pressure sidewall 22 and a suction sidewall 24 which are joined together to define the airfoil leading edge 26 (which is also referred to as the front of the airfoil) and a trailing edge 28 (which is also referred to as the rear of the airfoil). The sidewalls 22, 24 are spaced apart and have internal wall surfaces 30, 32 defining an airfoil cavity 34 extending from the leading to the trailing edge (the chordwise direction) and from the tip to the base (the spanwise direction) of the airfoil. In this embodiment the cavity 34 is divided into four distinct channels, each having its own inlet, by a plurality of ribs 36, which are distinguished from each other by letter suffixes for ease of reference. The ribs 36F, 36G, and 36H extend through the root 12 and divide the root into four distinct coolant inlet passages 38, 40, 42 and 44.

Coolant entering the passage 44 communicates solely with a spanwise extending trailing edge coolant channel 46 formed between the rib 36G and the trailing edge 28. All the coolant entering the channel 46 exits a trailing edge slot 48 after passing around and between a plurality of pedestals 50 which extend between the wall surfaces 30, 32 in a manner well known to those skilled in the art. Similarly, the rib 36A and the leading edge 26 define a spanwise extending leading edge channel portion 52 in series communication with the root passage 38. The channel portion 52 is also in series communication with a chordwise extending channel portion 54 formed between the chordwise extending rib 36J and the wall 56 forming the airfoil tip 16. Some of the coolant entering the channel portion 52 exits the leading edge 26 of the airfoil via a plurality of film coolant holes 58 therethrough. The remainder cools the tip wall 56 as it passes through holes 59 therethrough and as it moves downstream through the channel portion 54 and exits through an outlet 60 at the trailing edge.

The balance of the airfoil between the leading edge channel portion 52 and the trailing edge channel 46 is cooled by passing coolant in parallel through the legs of a pair of nested, serpentine channels formed by the ribs 36A through 36G. Each of the two serpentine channels has three substantially parallel spanwise extending legs. The rear-most leg 60 of a first one of the serpentine channels has its inlet 62 near the base 18 of the airfoil and receives coolant fluid from the passage 42 which is in series flow communication therewith. The second spanwise leg 64 of that channel is spaced apart from the leg 60 and is in series flow communication therewith via a chordwise extending leg 66 which interconnects the ends of the legs 60, 64 furthest removed from the root 12. The third or front-most spanwise leg 70 of the first serpentine channel is in series flow communication with the leg 60 via a short chordwise extending leg 72 which interconnects the ends of the legs 64, 70 nearest the root 12.

Disposed between the legs 60, 64 of the first serpentine passage and separated therefrom by the ribs 36D and 36F are the first two spanwise legs 74, 76 of the second serpentine channel. The legs 74, 76 are separated from each other by the rib 36E and are interconnected at their ends furthest from the root 12 by a short chordwise extending leg 80. The chordwise extending legs 66, 80 are separated from each other by a chordwise extending rib 82 which interconnects the ribs 36D and 36F. The rear-most leg 74 of the second serpentine channel receives coolant into its inlet 83 at the base 18 of the airfoil from the root passage 40 which is in series flow communication therewith. The leg 76 is in series flow communication with the third spanwise leg 84 of the second serpentine channel via a chordwise extending leg 86 which interconnects the ends thereof nearest the root 12.

In this embodiment a plurality of spanwise spaced apart film coolant passages 90 through the suction sidewall 24 intersect the cavity 34 along the length of the channel leg 70; and a plurality of spanwise spaced apart film coolant passages 92 through the pressure 22 intersect the cavity 34 along the length of the channel leg 84. Coolant entering the root passage 42 thereby makes three spanwise passes across the airfoil as it moves from the rear toward the front of the airfoil and exits through the film coolant passages 90. In similar fashion coolant entering the root passage 40 makes three passes across the span of the airfoil and exits the pressure side of the airfoil through the film coolant passages 92.

With this configuration, substantially all the coolant entering the passages 40, 42 is used to cool the entire portion of the airfoil between the leading and trailing edge channels 46, 52 and is ejected near the front of the airfoil. Furthermore, separate coolant flows are provided for the external pressure and suction surfaces of the airfoil; and these flows can be at different pressures such that the rate of coolant flow to the suction surface of the airfoil relative to the rate of coolant flow to the pressure side surface of the airfoil may be more readily controlled.

Although not shown in the drawing, all of the coolant channels within the airfoil of FIG. 1 (as well as the coolant channels of the airfoils of the other embodiments herein described) are provided with "trip strips" along their length for creating turbulence along the channels within the cavity 34, thereby increasing heat transfer rates. Trip strips are wall protuberances within the channels and are described in some detail in, for example, commonly owned U.S. Pat. Nos. 4,257,737; 4,416,585; 4,514,144; and 4,627,480 which are incorporated herein by reference. Trip strips are well known in the art and do not form a part of the present invention.

Figure 4:
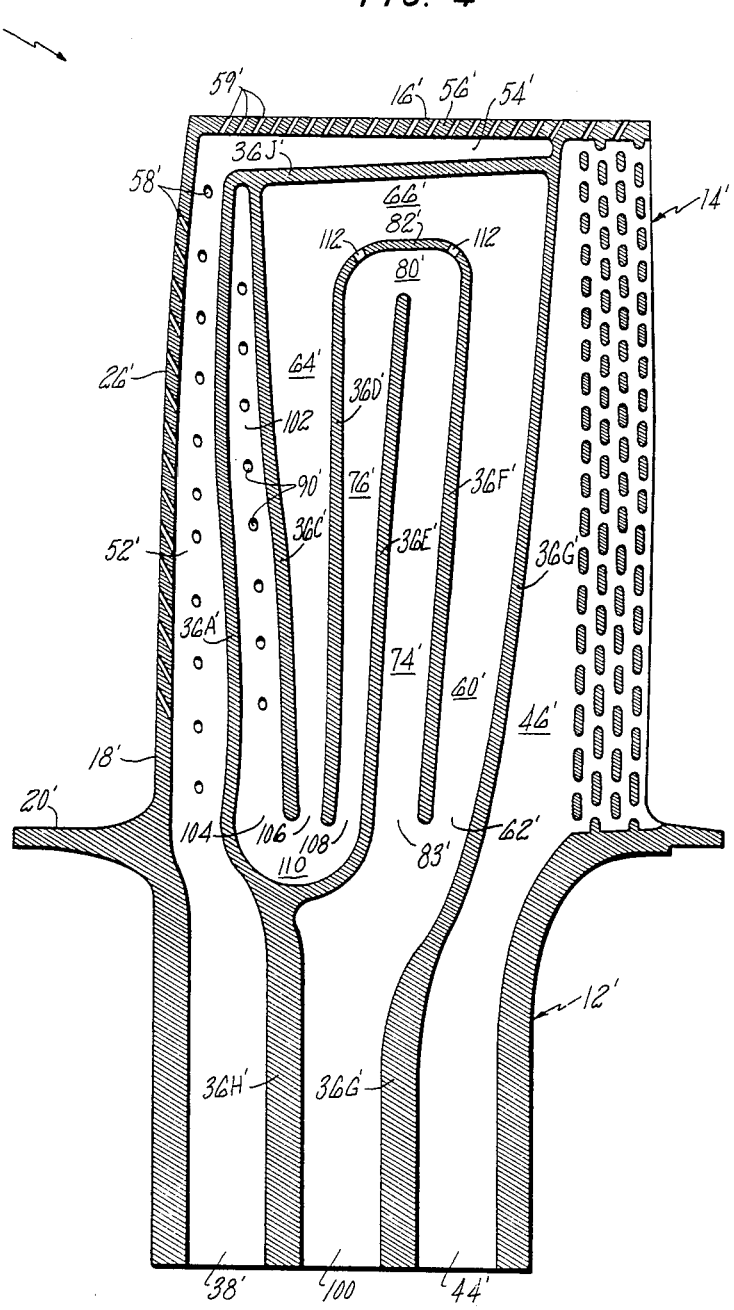
FIG. 4 is a sectional view of a modified version of the airfoil of FIG. 4, but showing an alternate embodiment of the present invention.

FIG. 4 shows another embodiment of the present invention. For ease of explanation, elements of the blade of FIG. 4 which are analagous to elements of the blade shown in FIGS. 1 thru 3 have been given the same reference numeral followed by a prime (') superscript. The simplest manner of describing the embodiment of FIG. 4 is that it is, in all important respects, the same as the embodiment of FIG. 1 except the rib 36B of FIG. 1 and the lower portion (i.e. that portion within the blade root) of the rib 36F of FIG. 1 have been removed. The removal of the lower portion of rib 36F results in a common plenum or coolant inlet passage 100 which feeds the inlets 62', 83' of the two serpentine channels. Removal of the rib 36B results in a common downstream channel leg 102 for both serpentine channels. The inlet 104 of the channel 102 is fed from the outlets 106, 108 of the legs 64', 76', respectively, of the serpentine channels. The outlets 106, 108 are in fluid communication with the inlet 104 through a short chordwise extending channel leg 110.

Of course, in the embodiment of FIG. 4, the coolant pressure within both serpentine channels is the same; however, the internal passageways may be easier to manufacture since the channel leg 102 is much wider than the legs 70, 84. As a further manufacturing aid the embodiment of FIG. 4 also includes a pair of cross-over holes 112 through the rib 82' which interconnect the chordwise extending legs 66', 80'. These are provided for the purpose of enabling the casting core for the blade to be made stronger.

Figure 5:
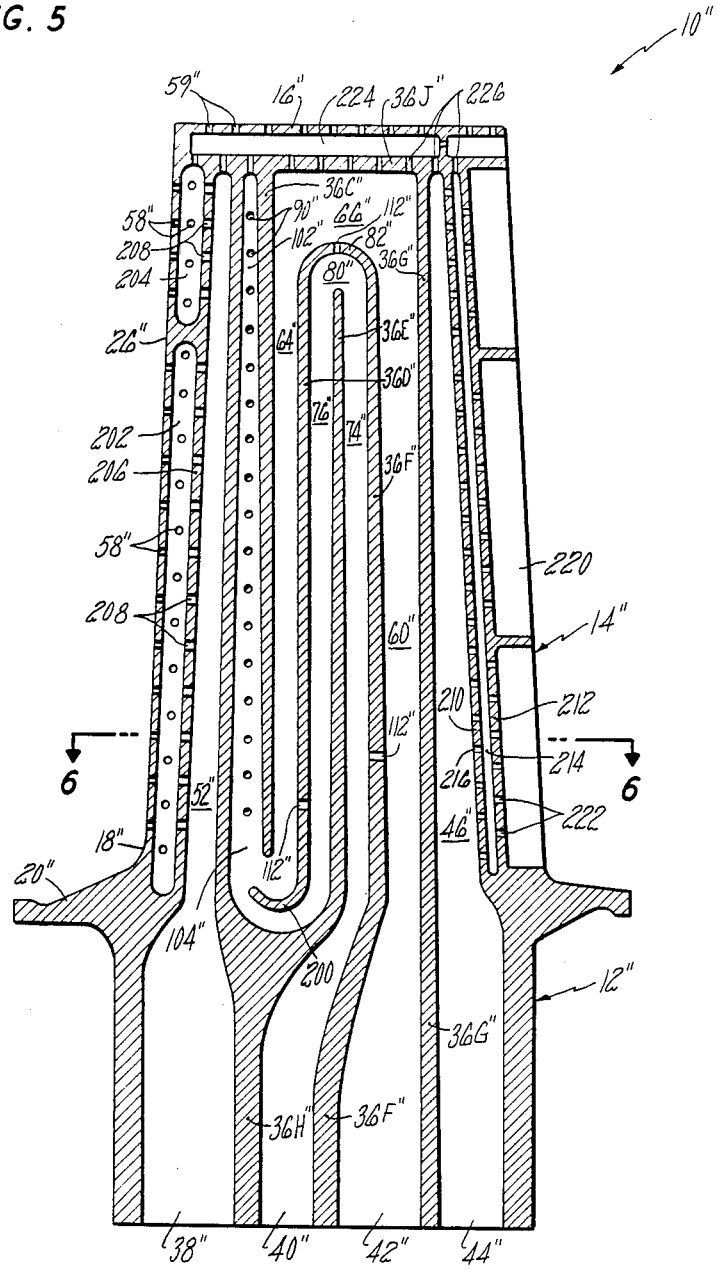
FIG. 5 is a sectional view similar to the view of FIG. 1, showing yet another embodiment of the present invention.

In the embodiment depicted in FIGS. 5 and 6, elements analagous to the elements of the embodiments of FIGS. 1 and 4 are given the same but double primed (") reference numerals for ease of distinguishing between the two embodiments. As best shown in FIG. 5, the serpentine channel configuration is substantially the same as in the embodiment of FIG. 4 except the rib 36F" extends through the root (as in the embodiment of FIG. 1) such that each serpentine channel has its own distinct coolant inlet passage 40", 42", respectively. Additionally, turning losses within the serpentine channels are further reduced by adding a U-shaped chordwise extending rib 200 to the end of the rib 36D".

The leading edge, trailing edge, and tip cooling configuration of the embodiment shown in FIGS. 5 and 6 is also different from the previous two embodiments. As shown, the cavity 34" includes a pair of longitudinally extending compartments 202, 204 immediately behind or rearward of the leading edge 26". The wall or rib 206 which separates the leading edge cooling channel portion 52" from the compartments 202 and 204 has a plurality of impingement cooling holes 208 therethrough. Coolant fluid within the channel portion 52" passes through the holes 208 and impinges against the rear surface of the airfoil leading edge. That cooling fluid thereupon leaves the compartments 202, 204 through the film cooling holes 58".

Near the trailing edge of the airfoil a pair of longitudinally extending, spaced apart walls or ribs 210, 212 define a longintudinally extending compartment 214 therebetween immediately downstream of and parallel to the trailing edge channel portion 46". Coolant from the channel portion 46" passes through a plurality of holes 216 and impinges upon the rib 212. Some of that coolant fluid leaves the compartment 214 through a plurality of film coolant holes 218 through the pressure sidewall 22" and some is fed into the airfoil trailing edge slot 220 through a plurality of holes 222 through the rib 212.

The wall forming the airfoil tip 16" is spaced from the rib 36J" to form a tip cooling compartment 224 therebetween. A portion of the coolant fluid within the compartment 204, the leading edge channel portion 52", the serpentine channels, the trailing edge channel portion 46", and the trailing edge compartment 214, is directed into the tip compartment 224 through a plurality of impingement cooling holes 226. Further cooling of the tip 16" occurs by passing the coolant fluid from the compartment 224 out of the airfoil through a plurality of holes 59" through the tip.

Figure 7:
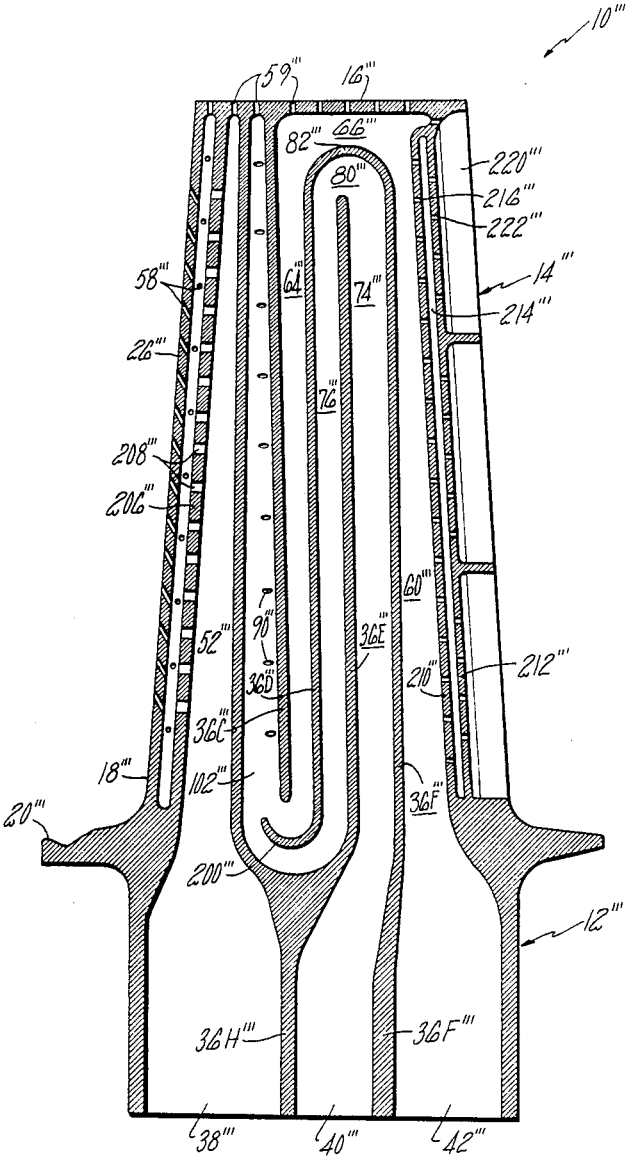
FIG. 7 is a sectional view of a modified version of the airfoil of FIG. 5 showing another embodiment of the present invention.

Yet another embodiment of the present invention is shown in FIG. 7, which is a modified version of the turbine blade depicted in FIGS. 5 and 6. In FIG. 7 triple primed reference numerals are used to indicate elements analagous to similarly numbered elements of previous embodiments. As can be seen from the drawing, the major differences between these two blades is that the blade of FIG. 7 does not include the separate, root-fed, span-wise extending trailing edge coolant channel 46" (in FIG. 6). Instead, the trailing edge compartment 214''' in FIG. 7 (which corresponds with the trailing edge compartment 214 in FIGS. 5 and 6) is fed directly from the first or rearward-most leg 60''' of one of the serpentine channels via a plurality of spanwise spaced apart holes 216''' through the rib 210'''.

The tip configuration is also different. In the embodiment of FIG. 7 the wall defining the airfoil tip 16''' is cooled by a combination of convection resulting from the flow of coolant through the chordwise extending channel leg 66''', and by passing coolant from the various channel legs through holes 59''' through the tip wall. As in the other embodiments described herein, that fluid provides some film cooling of the tip surface.

Although the invention has been shown and described with respect to a preferred embodiment thereof, it should be understood by those skilled in the art that other various changes and omissions in the form and detail of the invention may be made without departing from the spirit and scope thereof.

We claim:

1. A turbine blade comprising a root portion and wall means integral with said root portion defining an airfoil, said wall means including a pressure sidewall and a suction sidewall, joined together to define a forwardly located leading edge and a rearwardly located trailing edge of said airfoil and spaced apart to define a spanwise and chordwise extending coolant cavity within said airfoil, said root portion including root passage means therethrough for receiving coolant fluid from outside the blade and for directing said fluid into said airfoil cavity, wherein the improvement comprises:

rib means within said cavity forming two U-shaped channels within said cavity, a first of said U-shaped channels having forward and rearward spaced apart, spanwise extending legs interconnected to each other at their ends farthest removed from said root portion by a first chordwise extending leg, the second of said U-shaped channels having forward and rearward spanwise extending legs disposed between said forward and rearward legs of said first channel and separated therefrom and from each other by said rib means, said forward and rearward legs of said second channel being interconnected to each other at their ends farthest removed from said root portion by a second chordwise extending leg separated from said first chordwise extending leg by said rib means; and wherein the rearward leg of each said U-shaped channels each has an inlet at its end nearest said root portion in communication with said root portion passage means for receiving coolant fluid therefrom.

2. The turbine blade according to claim 1, wherein the forward leg of each of said U-shaped channels has an outlet at its end nearest said root portion; and said rib means further forms airfoil passage means within said cavity in series fluid flow communication with at least one of said U-shaped channels for carrying coolant fluid from each of said forward leg outlets spanwise across said cavity forward of both of said U-shaped channels.

3. The turbine blade according to claim 1, wherein said root portion passage means includes separate primary passages therethrough, each communicating with a respective one of said channel inlets.

4. The turbine blade according to claim 2, wherein said airfoil passage means comprises a pair of adjacent, separate, parallel, spanwise extending channel legs disposed forward of said U-shaped channels, each leg of said pair of legs having an inlet at its end nearest said root portion, said inlet of the forward-most one of said pair of channel legs being interconnected to said outlet of said forward leg of said second U-shaped channel to receive coolant fluid therefrom and form a first serpentine channel therewith, and said inlet of the other one of said pair of channel legs being interconnected to said outlet of said forward leg of said first U-shaped channel to receive coolant fluid therefrom and form a second serpentine channel therewith.

5. The turbine blade according to claim 2, wherein said cavity includes means defining a spanwise extending leading edge cooling channel forward of said airfoil passage means, said root portion passage means including a leading edge passage therethrough for directing coolant into said leading edge cooling channel for cooling said leading edge.

6. The turbine blade according to claim 5, wherein said cavity includes means defining a spanwise extending trailing edge coolant channel rearward of said rearward leg of said first U-shaped channel, said root portion passage means including a trailing edge passage therethrough for directing coolant into said trailing edge cooling channel for cooling said trailing edge.

7. The turbine blade according to claim 5, wherein said airfoil includes a tip integral with said sidewalls and means defining a tip cooling channel extending along the chordwise length of said tip and adjacent thereto for carrying coolant fluid into heat exchange relation with said tip, said tip cooling channel being separate from said U-shaped channels and from said airfoil passage means and in series flow relation with said leading edge cooling channel for receiving cooling fluid from said leading edge cooling channel.

8. The turbine blade according to claim 4, wherein said root portion passage means includes separate primary passages therethrough, each communicating with a respective one of said channel inlets, and wherein said pressure and suction sidewalls include a plurality of film coolant passages therethrough intersecting said cavity and located such that the coolant within one of said U-shaped channels exits said cavity via said film coolant passages through said pressure sidewall at the first pressure, and the coolant flowing within the other one of said U-shaped channels exits said cavity via said film coolant passages through said suction sidewall at a second pressure different from said first pressure.

9. The turbine blade according to claim 1 wherein at least one of said pressure and suction sidewalls includes a plurality of film coolant passages therethrough intersecting said cavity for providing outlets for the coolant fluid within said U-shaped channels.

10. The turbine blade according to claim 4 wherein said root portion passage means includes separate primary passages therethrough, each communicating with a respective one of said channel inlets.

11. The turbine blade according to claim 2 wherein said root portion passage means includes separate primary passages therethrough, each communicating with a respective one of said channel inlets.

* * * * *